US007066507B2

(12) United States Patent
Don

(10) Patent No.: US 7,066,507 B2
(45) Date of Patent: Jun. 27, 2006

(54) POST-REMOVABLE CONSTRUCTION OF A DOOR LOCK DEVICE

(75) Inventor: Lan-Kun Don, Chiayi (TW)

(73) Assignee: Tong Lung Metal Industry Co., Ltd., Chiayi (TW)

( * ) Notice: Subject to any disclaimer, the term of this patent is extended or adjusted under 35 U.S.C. 154(b) by 116 days.

(21) Appl. No.: 10/766,255

(22) Filed: Jan. 28, 2004

(65) Prior Publication Data

US 2004/0189022 A1 Sep. 30, 2004

(30) Foreign Application Priority Data

Jan. 29, 2003 (TW) ..... 92201845 U

(51) Int. Cl.
*E05B 3/00* (2006.01)

(52) U.S. Cl. ..... 292/336.3; 292/169; 292/347; 292/348; 292/356; 292/357; 292/DIG. 53; 292/DIG. 54; 70/224

(58) Field of Classification Search ..... 292/336.3, 292/347, 348, 356, 357, 169, DIG. 53, DIG. 54; 70/224, 215, 216, 451, 452, 472
See application file for complete search history.

(56) References Cited

U.S. PATENT DOCUMENTS

| | | | | |
|---|---|---|---|---|
| 3,228,218 | A * | 1/1966 | Wilson | 70/475 |
| 4,428,212 | A | 1/1984 | Best et al. | |
| 4,852,922 | A * | 8/1989 | Shih | 292/336.3 |
| 4,869,083 | A * | 9/1989 | DeMarseilles et al. | 70/224 |
| 5,141,269 | A * | 8/1992 | Haq et al. | 292/169 |
| 5,265,924 | A * | 11/1993 | Kim | 292/336.3 |
| 5,385,374 | A * | 1/1995 | Fann et al. | 292/336.3 |
| 5,481,890 | A * | 1/1996 | Millman | 70/224 |
| 5,727,406 | A * | 3/1998 | Banducci | 70/224 |
| 5,761,936 | A | 6/1998 | Katayama | |
| 5,794,472 | A * | 8/1998 | Kester et al. | 70/472 |
| 5,904,232 | A * | 5/1999 | Shen | 192/69.62 |
| 6,279,360 | B1 * | 8/2001 | Shen | 70/224 |
| 6,302,457 | B1 * | 10/2001 | Shen | 292/357 |
| 6,575,006 | B1 * | 6/2003 | Don | 70/472 |
| 6,742,820 | B1 * | 6/2004 | Shen | 292/336.3 |
| 6,893,059 | B1 * | 5/2005 | Shen | 292/169 |

FOREIGN PATENT DOCUMENTS

| | | |
|---|---|---|
| TW | 476369 | 2/2002 |

* cited by examiner

*Primary Examiner*—Brian E. Glessner
*Assistant Examiner*—Carlos Lugo
(74) *Attorney, Agent, or Firm*—Senniger Powers

(57) ABSTRACT

A post-removable construction of a door lock device which is disposed on a plate assembly. The plate assembly can be applied to install a transmission mechanism comprised of an inner spindle, an outer spindle, an inner lever, and outer lever and a latch-retracting mechanism onto a door panel, and drives a latch. The plate assembly is comprised of an inner housing assembly inboard of the door panel and an outer housing assembly outboard of the door panel.

6 Claims, 4 Drawing Sheets

POST-REMOVABLE CONSTRUCTION OF A DOOR LOCK DEVICE

FIELD OF INVEMTION

The present invention is related to a post-removable construction of a door lock device, which is adapted to optional installations of a door lock device to a door panel formed with or without positioning holes.

BACKGROUND

Conventionally, some door panels of conventional doors are formed, in addition to a mounting hole for mounting a door lock device, with positioning holes around the mounting hole to allow posts of the door lock device passing therethrough for increasing strength for resisting torsional damage to the door lock device. Some door panels, however, are formed with no such positioning holes, rendering that the installation of the door lock device to the doors is inconvenient.

In view of the above, the present invention provides a door lock device with two removable posts, so that the door lock device is adapted for installation to a door panel formed with or without positioning holes.

SUMMARY OF INVENTION

A primary object of the present invention is to provide a post-removable construction of a door lock device, so that the door lock device is adapted to an installation on a door formed with or without positioning holes.

A post-removable construction of a door lock device of the present invention comprises:

an outer housing having a body with a through hole formed on a center of the body;

a positioning plate having a body, which is disposed on the outer housing; the body having a through hole;

at least one recess formed on the body of the positioning plate, the recess having a pair of opposite engaging edges;

at least one stationary post formed on the body of the positioning plate;

at least one reinforcing post having two end portions with one end portion thereof having a pair of opposite engaging slits for respectively engaging the pair of opposite engaging edges of the positioning plate;

an outer seat having a body with a through hole formed on a center of the body, the outer seat having at least one first aperture being provided on the body thereof for allowing the at least one reinforcing post to pass therethrough;

at least one second aperture being provided on the body of the outer seat and spaced apart from the at least one first aperture, for allowing the stationary post to pass therethrough;

an inner seat having a body with a through hole formed on a center of the body, the inner seat having at least one second aperture formed around the through hole of the inner seat; and at least one second bolt adapted to pass through the second aperture of the inner seat to engage the at least one stationary post.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF PREFERRED EMBODIMENTS OF THE INVENTION

Figure 1:
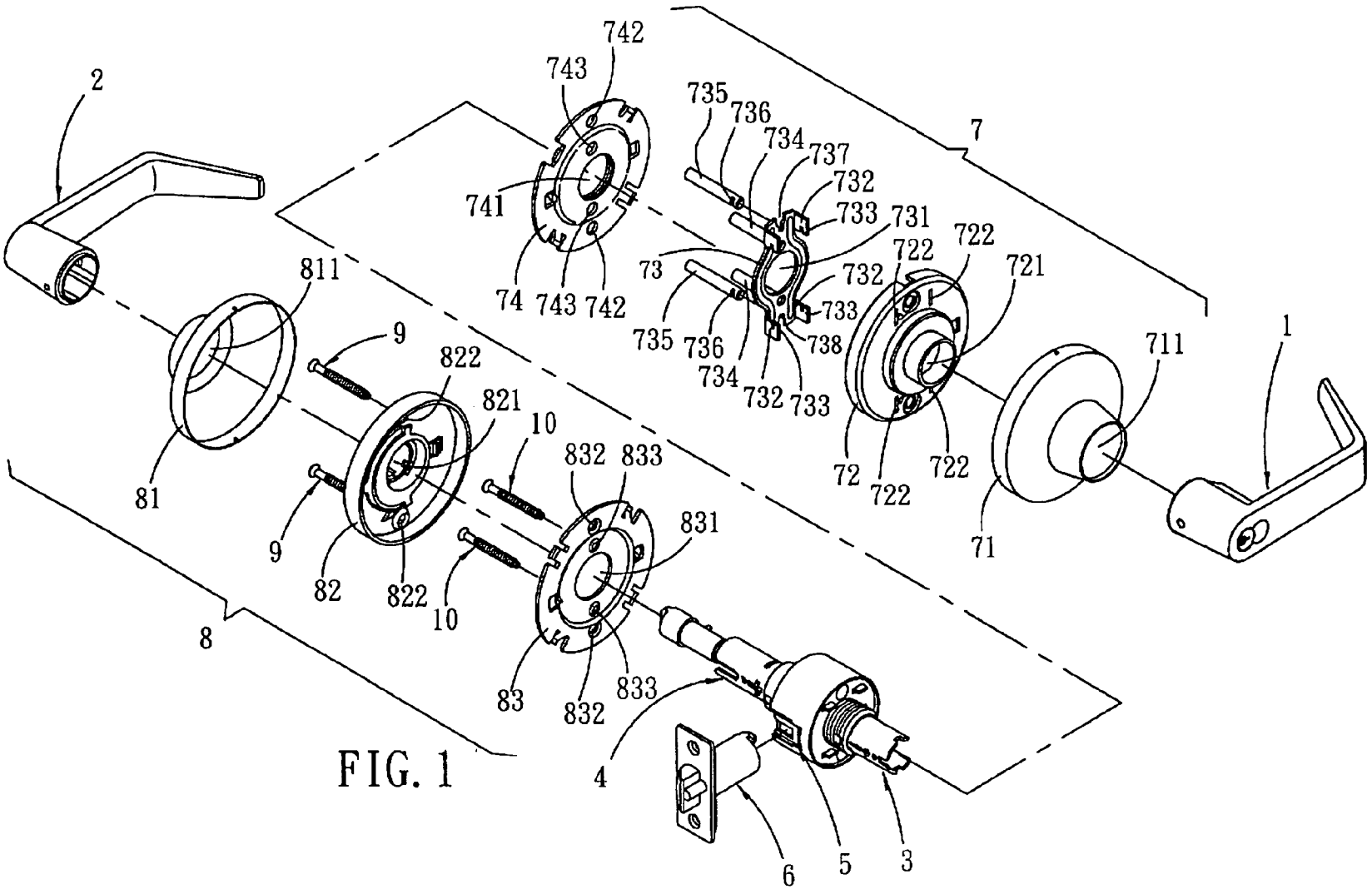
FIG. 1 is an exploded view of the first preferred embodiment of the present invention.
Figure 2:
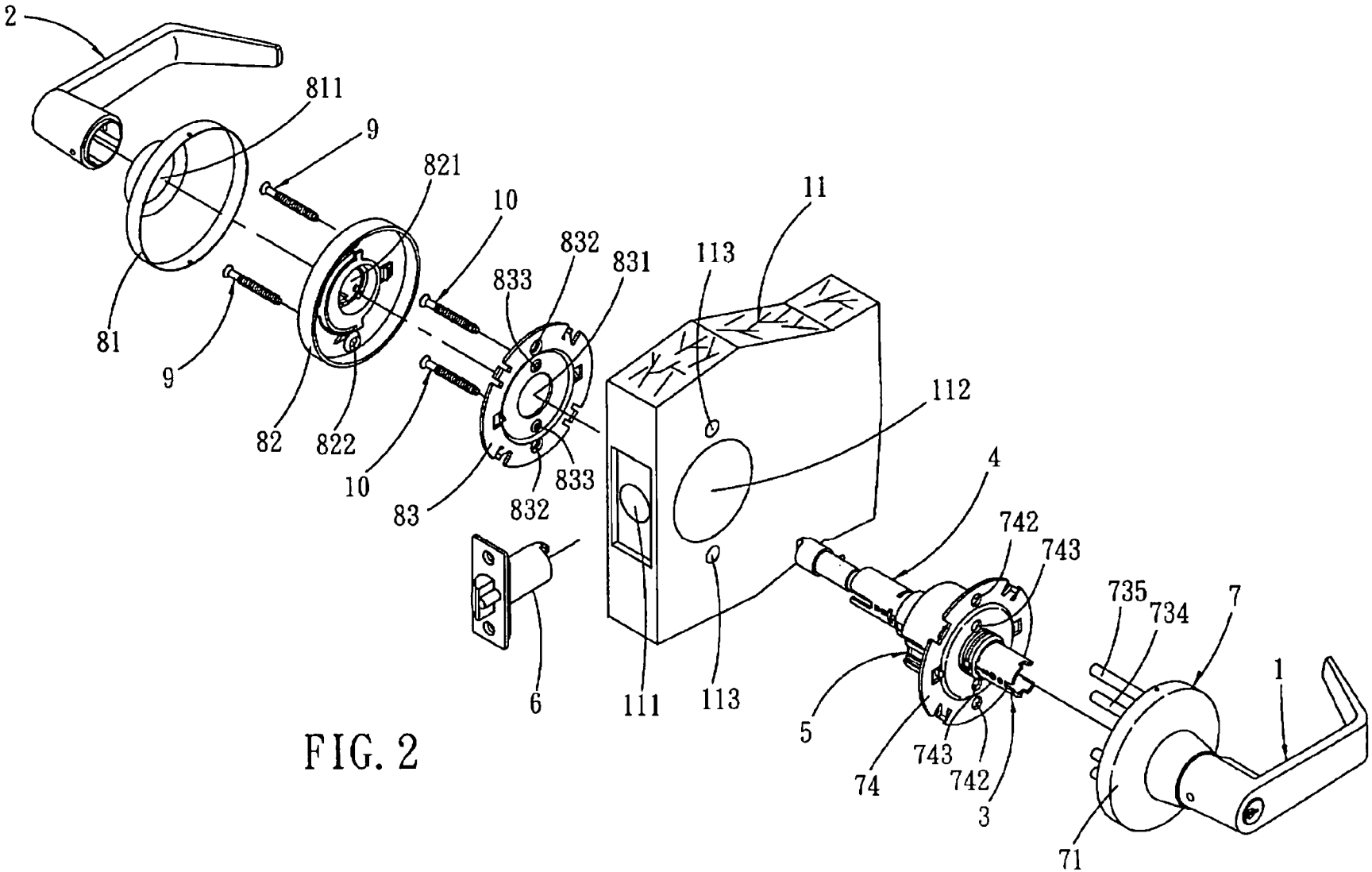
FIG. 2 is another exploded view of the first preferred embodiment of the present invention, in which the outer housing assembly has been partly assembled.
Figure 4:
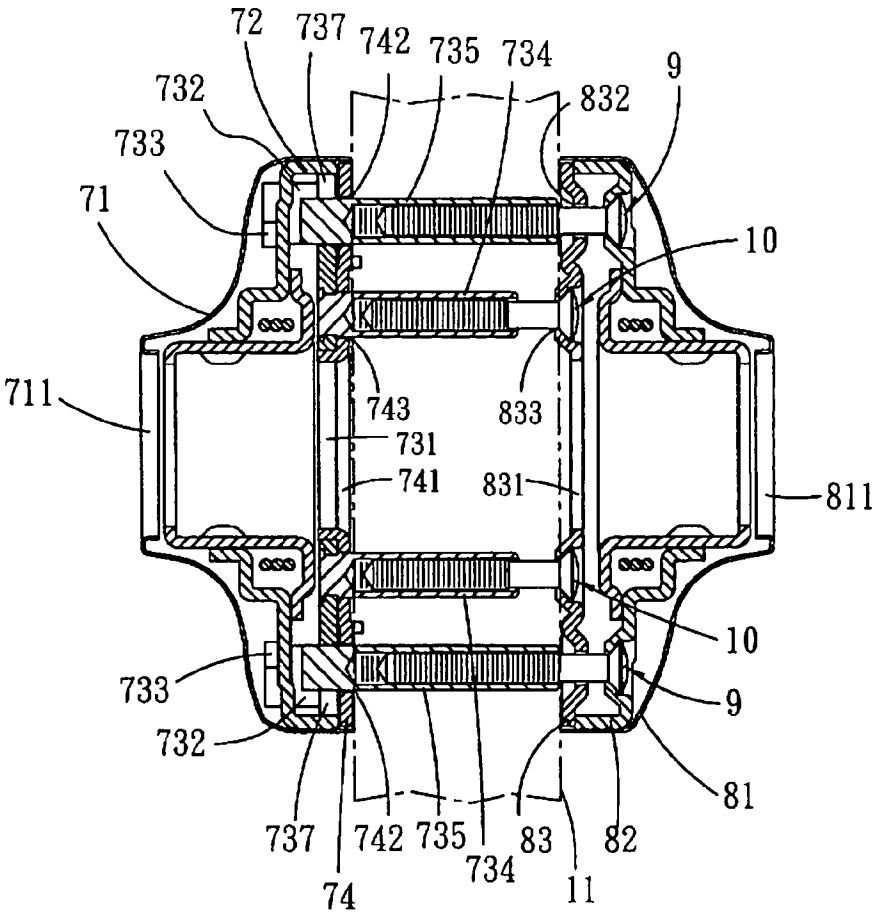
FIG. 4 is a cross-sectional view schematically showing the inner housing assembly and the outer housing assembly of the preferred embodiment of the present invention in an assembled condition.

With reference to FIGS. 1 and 2, a post-removable construction of a door lock device according to the first preferred embodiment of the present invention is disposed within a plate assembly of a door lock device, so that a transmission mechanism comprised of an inner spindle 4, an outer spindle 3, an inner lever 2, an outer lever 1 and a latch-retracting mechanism 5 is installed on a mounting hole 112 of a door panel 11, and so that the operation of the transmission mechanism of the door lock device may drive a latch 6 disposed within a latch hole 111 of the door panel 11. The plate assembly is comprised of an inner housing assembly 8 disposed inboard of the door panel 11 and an outer housing assembly 7 disposed outboard of the door panel 11. The outer housing assembly 7 comprises an outer cover 71, an outer housing 72, a positioning plate 73 and an outer seat 74, wherein the outer cover 71 is formed with a body having a through hole 711.

The outer housing 72 is formed with a body having a through hole 721 and four apertures 722 around the through hole 721.

Figure 3:
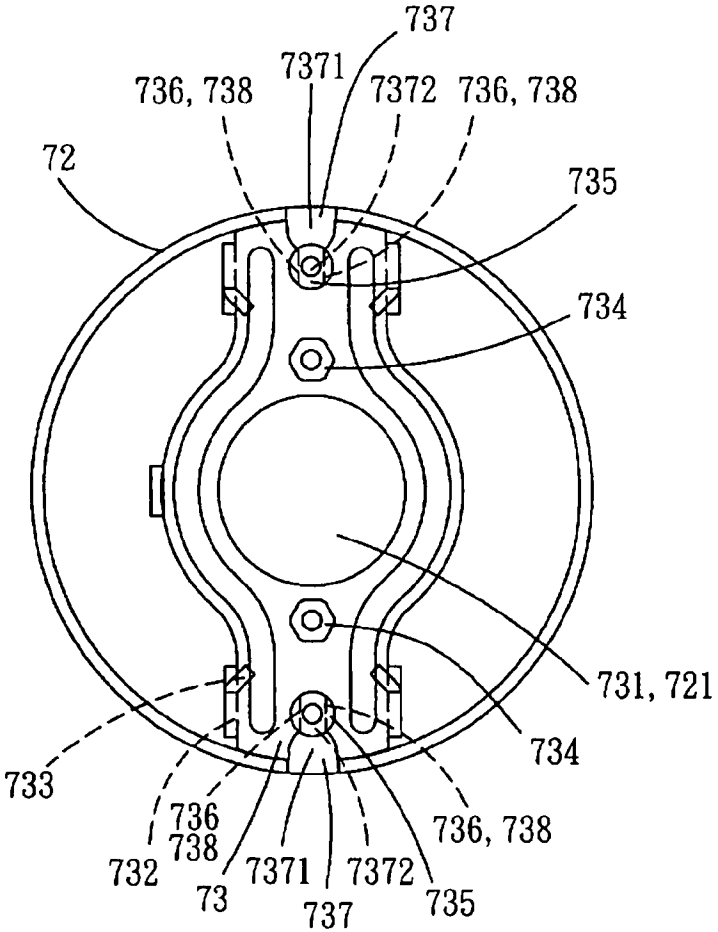
FIG. 3 is a plan view showing that the outer housing and the positioning plate of the present invention are in an assembled condition.

The positioning plate 73 is formed with a body having a through hole 731. Four projections 732 are formed on and axially extending from the body of the positioning plate 73. Each projection 732 is formed with a securing portion 733 having a bent, and is adapted to pass the corresponding aperture 722 of the outer housing 72 and engages the outer housing 72. Two recesses 737 are formed on the body of the positioning plate 73. As can be seen in FIGS. 1 and 3, the recess 737 is formed by a first recess 7371 and a second recess 7372 in communication with the first recess 7371. The second recess 7372 has a pair of opposite engaging edges 738 (see FIG. 3). Two stationary posts 734 are spaced apart from each other, and are formed on and extend axially from the body of the positioning plate 73.

Two reinforcing posts 735 each has two ends, in which one end of one reinforcing post 735 is formed with a pair of opposite engaging slits 736 (engaging portion) for engaging the pair of opposite engaging edges 738 (see FIG. 3) of the positioning plate 73. The other end of the reinforcing post 735 is axially formed with internal threads. Some stationary posts in practice need no the provision of internal thread.

The outer seat 74 is formed with a body having a through hole 741. Two first apertures 742 are formed on the outer seat 74 to allow the reinforcing posts 735 to pass therethrough. Two second apertures 743 are formed on the outer seat 74 and are spaced apart from the first apertures 742 to allow the stationary posts 734 to pass therethrough.

The inner housing assembly 8 comprises an inner cover 81, an inner housing 82 and an inner seat 83, in which the inner cover 81 is formed with a body having a through hole 811.

The inner seat 83 is formed with a body having a through hole 831. Two first apertures 832 spaced apart from each other and two second apertures 833 spaced apart from each other are formed on the body of the inner seat 83.

Two second bolts 10 respectively pass through the second apertures 833 of the inner seat 83 and engage the stationary posts 734.

The inner housing 82 is formed with a body having a central hole 821. Two first apertures 822 spaced apart from each other are formed around the through hole 821.

Two first bolts 9 pass through the first apertures 822 of the inner housing 82 and the first apertures 832 of the inner seat 83, and engage the reinforcing posts 735, respectively.

As illustrated in FIGS. 1–4, the reinforcing posts 735 of the post-removable construction of a door lock device according to the present invention are removably disposed on the outer housing assembly 7, so that it can be optionally installed on a conventional door panel formed with positioning holes 113 or without positioning holes 113. FIG. 2 shows a door panel 11 formed with two positioning holes 113.

Generally, in an assembling process of a door lock device in a manufacturing factory, the reinforcing post 735 is axially aligned with and put into the first recess 7371 of the positioning plate 73, and is then moved into the second recess 7372 of the positioning plate 73, so that the pair of engaging slits 736 of the reinforcing post 735 engage the engaging edges 738 of the positioning plate 73. The first apertures 742 and the second apertures 743 of the outer seat 74 are then respectively aligned with the reinforcing posts 735 and the stationary posts 734, allowing the reinforcing posts 735 and the stationary posts 734 to pass therethrough and are positioned. Therefore, if a user intends to install the door lock device to a door panel formed with two positioning holes 113, he is only required to mount the transmission mechanism and the outer housing assembly 7 from the outside of the door panel to the mounting hole 112 and the positioning holes 113, so that the latch-retracting mechanism 5 of the transmission mechanism engages the latch 6 disposed within the latch hole 111 (this part was known and is not redundantly described herewith). The inner seat 83 is then mounted from the inside of the door, so that the second apertures 833 of the inner seat 83 are respectively aligned with the stationary posts 734. Two second bolts 10 then pass through the second apertures 833 of the inner seat 83 and engage the stationary posts 734. Each of the first apertures 822 of the inner housing 82 is aligned with one of the reinforcing posts 735. Two first bolts 9 then respectively pass the first aperture 822 of the inner housing 82 and the first aperture 832 of the inner seat 83, and engage the reinforcing posts 735. Mounting the inner cover 81 to the inner housing 82 accomplishes the assembling of the components for the door lock device.

With reference to FIGS. 1 through 4, if a user intends to install the door lock device to a door panel formed without the positioning holes 113, he has to first remove from the outer housing assembly 7 the reinforcing posts 735 that were already assembled in the manufacturing factory. In a removing operation, the outer seat 74 and the outer housing 72 are firstly separated from each other, and then each of the reinforcing posts 735 is moved from the second recess 7372 to the first recess 7371 of the positioning plate 73, and is then detached from the positioning plate 73. Subsequently, the second apertures 743 of the outer seat 74 are respectively aligned with one of the stationary posts 734, allowing the stationary post 734 to pass therethrough and be positioned. After this, the user may install the transmission mechanism, the outer housing assembly 7 and inner housing assembly 8 onto the door panel 11 in a manner as described above.

Figure 5:
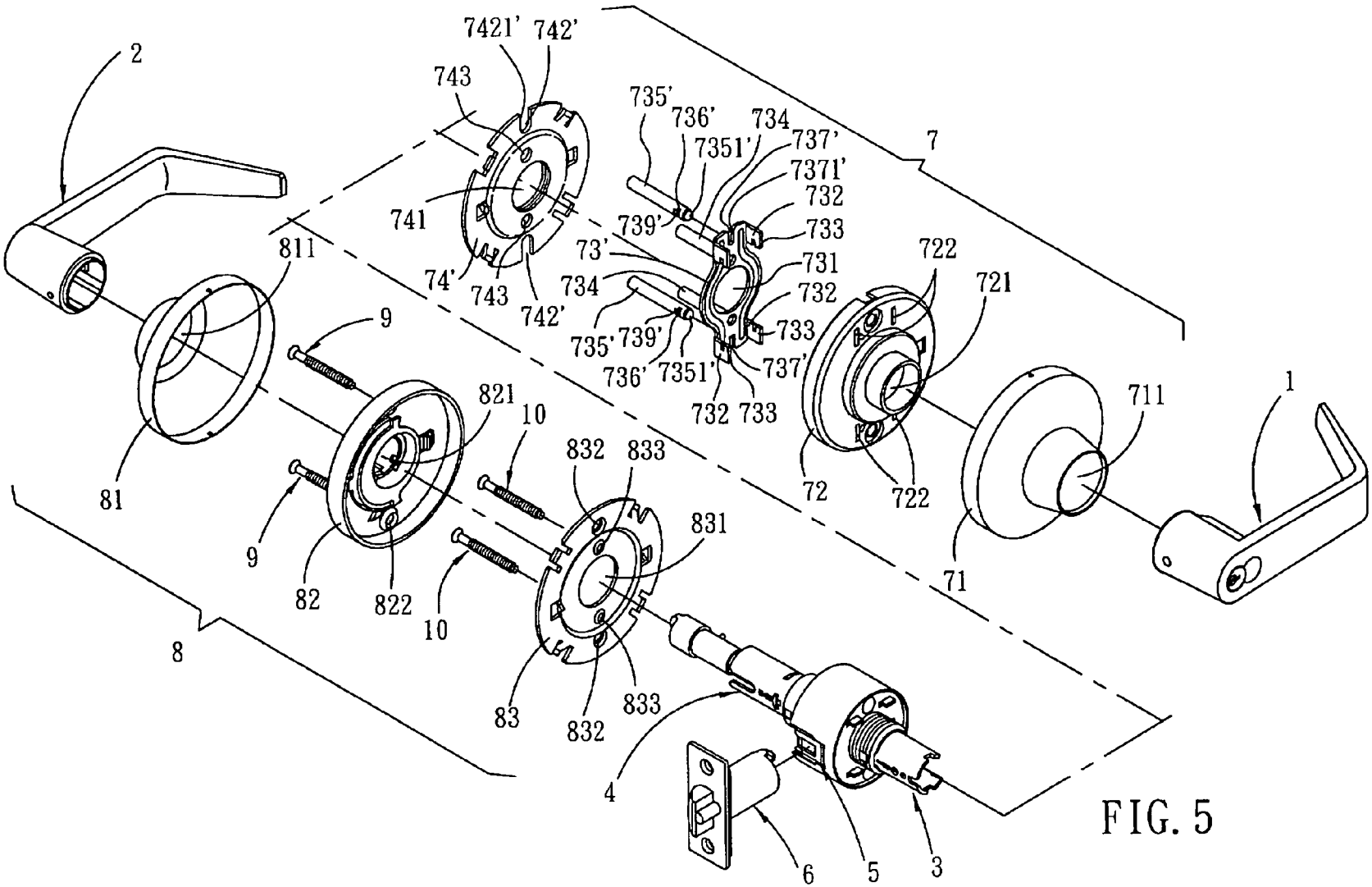
FIG. 5 is an exploded view of the second preferred embodiment of the present invention.

FIG. 5 is the second embodiment of the present invention which is similar to the first preferred embodiment illustrated in FIGS. 1 through 4, excepting the arrangement of the reinforcing posts to connect with the positioning plate, the outer seat, and the outer housing.

Specifically, in FIG. 5, the outer seat 74' is further formed with two recesses 742', which are provided at the peripheral edge of the outer seat 74'. Each recess 742' has a pair of opposite engaging edges 7421' substantially opposite to each other.

The positioning plate 73' is formed with two opposite recesses 737' having two opposite engaging edges 7371' opposite to each other.

Each of the reinforcing posts 735' has two ends, in which one end is formed with two pairs of engaging slits, namely a first pair of engaging slits 736' and a second pair of engaging slit 739'. The first pair of engaging slits 736' are adapted to engage the engaging edges 7371' of the recess 737' of the positioning plate 73'. The second pair of engaging slits 739' are adapted to engage the engaging edge 7421' of the recess 742' of the outer seat 74'. Instead of providing two pairs of the engaging slits 736' and 739', each end of the reinforcing post 735' can be provided with only a pair of engaging slits by integrally forming the slits 736' and 739', or other similar arrangement for the analogous engagement purpose.

Each reinforcing post 735' is also provided at its one terminal end with an elastomeric member 7351', such as a plastic or rubber cap, adapted to resiliently and tightly abut against the outer housing 72 when being assembled.

In assembling, the stationary posts 734 of the positioning plate 73' firstly pass through the apertures 743 of the outer seat 74', so that the outer seat 74' is attached and assembled on the positioning plate 73'. The two reinforcing posts 735' are then attached onto the positioning plate 73' and the outer seat 74', by laterally engaging the first pair of engaging slits 736' of the reinforcing posts 735' onto the engaging edges 7371' of the recess 737' of the positioning plate 73', and by laterally engaging the second pair of engaging slits 739' of the reinforcing post 735' onto the engaging edges 7421' of the recess 742' of the outer seat 74'. When being assembled, the elastomeric member 7351' attached on the terminal end of the reinforcing post 735' resiliently and tightly abuts against an inner side of the outer housing 72, so that the reinforcing post 735' is provided with a resiliently axial force to urge the first and second pairs of engaging slits 736' and 739' of the reinforcing post 735' to further firmly engage the recess 737' of the positioning plate 73' and the recess 742' of the outer seat 74, without being loosen among the reinforcing post, the positioning plate and the outer seat.

The above-described embodiment of the present invention is intended to be illustrated only. Numerous alternative embodiments, such as a design around concept to provide two engaging edges at the positioning plate and/or the inner seat with the edges having asymmetric contours, can be conceived by those skilled in the art without departing from the scope of the following claims.

What is claimed is:

1. A post-removable construction of a door lock device, comprising:

an outer housing having a body with a through hole formed thereon;

a positioning plate having a body, which is disposed on the outer housing; the body having a through hole;

at least one recess formed on the body of the positioning plate, the recess having two engaging edges;

an outer seat having a body with a through hole formed thereon, the outer seat having at least one recess formed with two engaging edges for allowing at least one reinforcing post to engage thereon;

the at least one reinforcing post having two end portion with one end portion thereof having a pair of engaging slits for engaging the engaging edge of the recess of the positioning plate and the engaging edge of the recess of the outer seat;

at least one aperture being provided on the body of the outer seat and spaced apart from the at least one first aperture, for allowing at least one stationary post to pass therethrough;

an inner seat having a body with a through hole formed thereon, the inner seat having at least one second aperture formed around the through hole of the inner seat; and at least one bolt adapted to pass through the second aperture of the inner seat to engage the at least one stationary post.

2. The post-removable construction of a door lock device according to claim 1, wherein the pair of reinforcing slits is composed of a first engaging slit and a second engaging slit for respectively engaging the engaging edge of the recess of the positioning plate and the engaging edge of the recess of the outer seat.

3. The post-removable construction of a door lock device according to claim 2, wherein the at least one stationary post is formed on the body of the positioning plate.

4. The post-removable construction of a door lock device according to claim 2, wherein the at least one reinforcing post is provided with an elastomeric member at one of a terminal end thereof in order that the reinforcing post resiliently and tightly abuts against an inner side of the outer housing when being assembled.

5. The post-removable construction of a door lock device according to claim 4, wherein the elastomeric member is made of plastic.

6. The post-removable construction of a door lock device according to claim 4, wherein the elastomeric member is made of rubber.

* * * * *